United States Patent [19]

Clay

[11] 4,249,436

[45] Feb. 10, 1981

[54] MACHINE AND METHOD FOR REMOVING A LABEL SEWN TO A WORKPIECE

[75] Inventor: Bobby J. Clay, Cincinnati, Ohio

[73] Assignee: Natmar, Inc., Cincinnati, Ohio

[21] Appl. No.: 83,253

[22] Filed: Oct. 10, 1979

[51] Int. Cl.[3] ..... B26D 1/38

[52] U.S. Cl. ..... 83/22; 83/24; 83/100; 83/167; 83/402; 83/529; 83/589; 83/616; 83/639; 29/426.4

[58] Field of Search ..... 83/100, 167, 402, 529, 83/589, 616, 639, 580, 610, 22, 24; 29/426.4, 426.5

[56] References Cited

U.S. PATENT DOCUMENTS

| | | | |
|---|---|---|---|
| 531,017 | 12/1894 | Blomgren | 83/589 |
| 2,661,519 | 12/1953 | Rubin | 26/11 |
| 2,827,867 | 3/1958 | Happe | 112/122 |
| 3,084,647 | 4/1963 | Matchett et al. | 112/252 |
| 3,125,052 | 3/1964 | Spivey | 112/252 |
| 3,217,680 | 11/1965 | Harris, Jr. et al. | 112/252 |
| 3,270,606 | 9/1966 | Schott, Jr. | 83/580 X |
| 3,334,533 | 8/1967 | Davis, Jr. | 83/100 |
| 3,356,054 | 12/1967 | Southwell et al. | 112/252 |
| 3,369,509 | 2/1968 | Burton | 112/129 |
| 3,690,276 | 9/1972 | King et al. | 112/252 |
| 3,815,533 | 6/1974 | Bray | 112/252 |
| 4,127,075 | 11/1978 | Adamski, Jr. et al. | 112/122 |

*Primary Examiner*—Frank T. Yost

*Attorney, Agent, or Firm*—Wood, Herron & Evans

[57] ABSTRACT

A label cut-off machine for removing a label sewn to a workpiece. The machine includes a label chamber sized to received the label through an access slot in one wall of that chamber. The access slot is defined by a reciprocable cutter bar and an anvil, the cutter bar and anvil presenting abutment faces which cooperate with the workpiece to allow positioning of the label's stitch line closely adjacent the cutter bar's cutting edge when the label is inserted into the label chamber. Operation of the cutter bar is controlled by the machine's operator. A vacuum source connected with the label chamber establishes a continuous vacuum in the chamber, the vacuum source cooperating to draw the label initially into the chamber through the access slot and to aid in locating the label stitch line initially adjacent the cutter bar's cutting edge, and the vacuum source also cooperating to remove the label from the label chamber after it has been cut off from the workpiece by the cutter bar.

17 Claims, 5 Drawing Figures

MACHINE AND METHOD FOR REMOVING A LABEL SEWN TO A WORKPIECE

This invention relates to cut off machines and methods. More particularly, this invention relates to a cut off machine and method for removing a label sewn to a workpiece.

In the garment industry, it is common practice for garments to be sold by the manufacturer to retail outlets with the manufacturer's trademark or brand name on a label attached to that garment. However, it is also common practice in the garment industry for manufacturers to sell excess industry, or to sell slightly imperfect but still saleable goods, to retail warehouse type outlets which resell the merchandise to the consuming public at less than the usual retail price for the same goods sold by normal retail outlets. In this latter situation, it is undesirable, from a garment manufacturer's standpoint, to allow resale of the excess inventory, or of slightly imperfect goods, at less than the preferred retail price under the manufacturer's own trademark or brand name. In this situation, therefore, it is common practice in the retail business for the manufacturer, or the buyer, of the excess inventory or slightly imperfect goods to remove the manufactuere's labels (with the manufacturer's trademark or brand name thereon) from the garments prior to presentation at retail, and to substitute therefor another label with, for example, the retail warehouse outlet's own name theron. This, of course, removes the marketing disadvantage of selling the garment manufacturer's goods with the garment manufacturer's trademark or brand name at less than retail price, while still providing the garments with labels having a so-called private brand name thereon at the retail warehouse type outlet.

In the past, it has been the practice in the industry to remove labels from garments simply through manual labor, scissors being the only tool available to a worker. In effect, and because the label is sewn between two sections of a garment, e.g., between the yoke and back of a shirt adjacent the collar of the shirt, the label must be carefully and meticulously cut off closely adjacent to the stitch line so that the evidence of a prior label is removed before a new label can be stitched to the garment. This, of course, is undesirable from the retailer's standpoint or manufacturer's standpoint as it is a labor intensive job that significantly increases the cost of the garment. This cost increase is, of course, in contradistinction to the objective of relabeling the garment, namely, to sell it at retail at a lower price than the regular retail price of the garment as originally manufactured.

Therefore, it has been the primary objective of this invention to provide a novel label cut off machine and method for removing a label sewn to a workpiece, e.g., a garment. In accord with this objective, this invention contemplates a label cut off machine that includes a label chamber sized to receive the label through an access slot in one wall of that chamber. The access slot is defined by a reciprocable cutter bar and an anvil, the cutter bar and anvil presenting abutment faces which cooperate with the workpiece to allow positioning of the label's stitch line closely adjacent the cutter bar's cutting edge when the label is inserted into the label chamber. Operation of the cutter bar is controlled by the machine's operator. A vacuum source connected with the label chamber establishes a continuous vacuum in the chamber, the vacuum source cooperating to draw the label initially into the chamber through the access slot and to aid in locating the label stitch line initially adjacent the cutter bar's cutting edge, and the vacuum source also cooperating to remove the label from the label chamber after it has been cut off from the workpiece by the cutter bar.

In preferred form, the cut-off motor is fluid operated and is controlled by a novel fluid circuit that is operated by a foot control switch. This relieves both hands of an operator for initially introducing the label into the vacuum exposed label chamber and positioning the stitch line of the label to the workpiece closely adjacent to and parallel to the cutting edge of the cutter bar, as well as retaining that label in cut off position while operating the cutter bar through use of the foot control switch.

Other objectives and advantages of this invention will be more apparent from the following detailed description taken in conjunction with the drawings in which.

Figure 1:
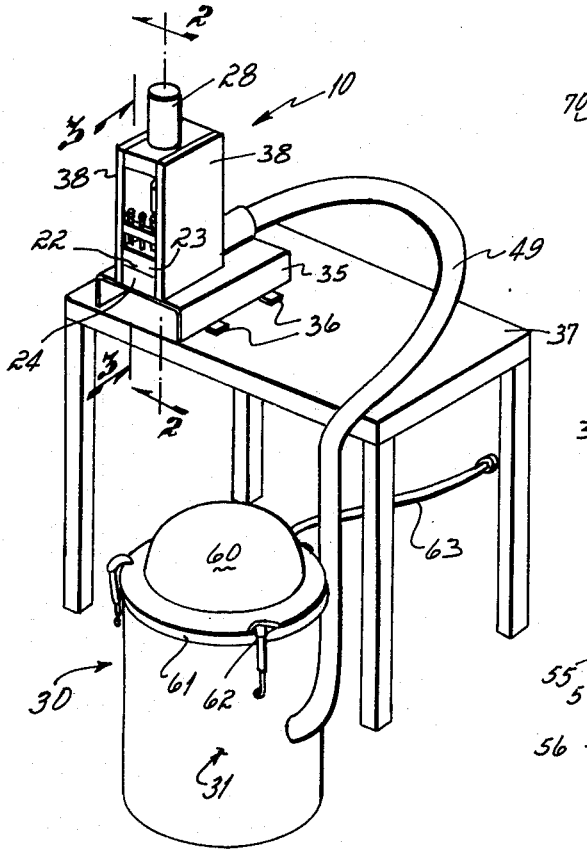
FIG. 1 is a perspective view illustrating a label cut off machine in accord with the principles of this invention.
Figure 4:
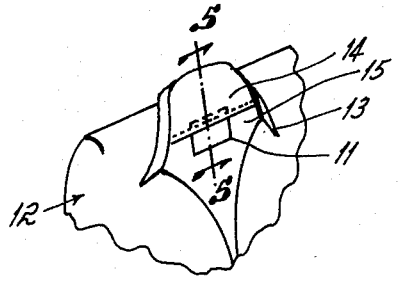
FIG. 4 is a perspective view illustrating a label sewn to a shirt, the label being adapted to be cut off by the machine and method of this invention.
Figure 5:
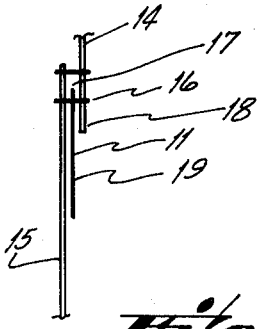
FIG. 5 is a cross-sectional view taken along line 5—5 of FIG. 4 showing the attachment of the label to the shirt in greater detail.

The label cut-off machine 10 for removing a label 11 sewn to a workpiece 12 is illustrated in perspective in FIG. 1. The label cut off machine 10, and method, are particularly adapted for use in removing labels 11 from shirts 12 of the type shown in FIGS. 4 and 5. As shown in FIG. 4, the shirt 12 is comprised of a collar 13, a yoke 14 and a shirt back 15, the label 11 being sewn between the shirt's yoke and the shirt's back. The label 11 itself is of a generally rectangular configuration, and is stitched to the shirt 12 along at least one of the same stitch lines 16 that connect the shirt yoke 14 with the shirt back 15. That edge 17 of the label 11 parallel to the stitch line 16, and closely adjacent to the stitch line, is concealed between the shirt yoke 14 and shirt back 15 after the label is stitched to the shirt 12. Further, and as shown particularly in FIG. 5, the shirt yoke 14 is provided with a lip 18 which partially overlies the label 11 on the exposed face 19 of the label. In other words, the label 11 is connected between the two workpiece sections 14, 15 and is stitched to both sections simultaneously by a stitch line 16 positioned so that the upper workpiece section 14 presents a lip 18 which partially overlies the label, and which can be folded back relative to that stitch line, as is discussed in subsequent detail below.

Figure 3:
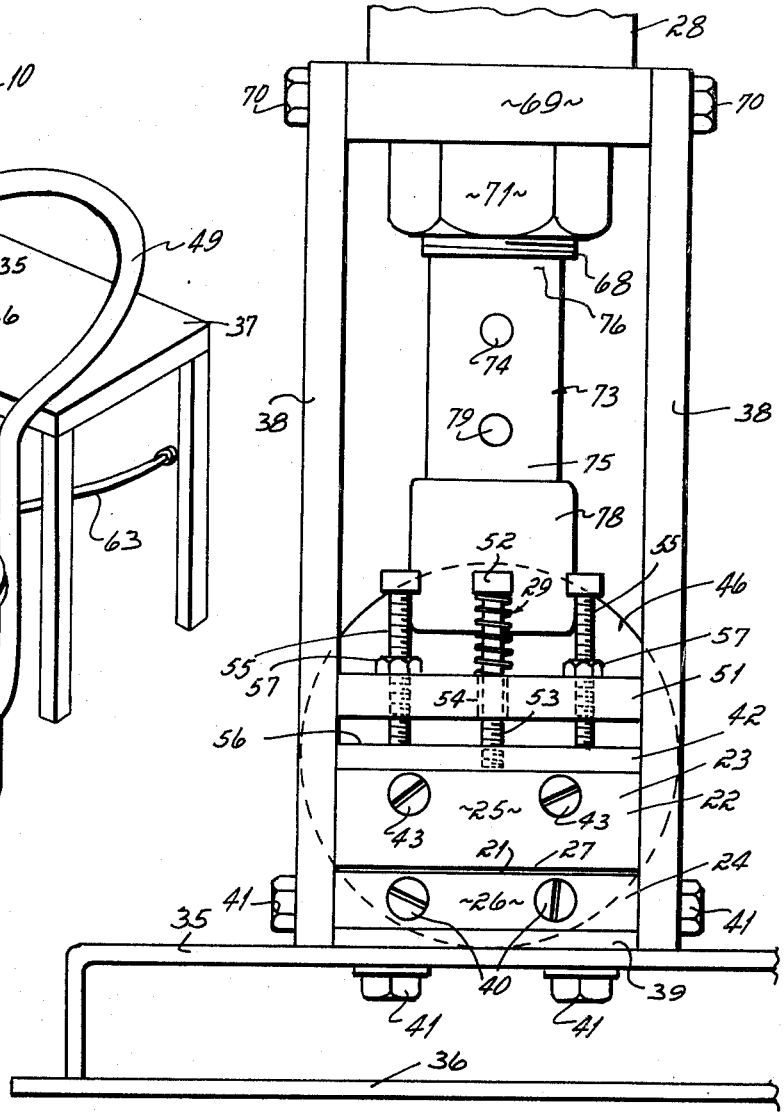
FIG. 3 is a front view of a machine taken along line 3—3 of FIG. 1.
Figure 2:
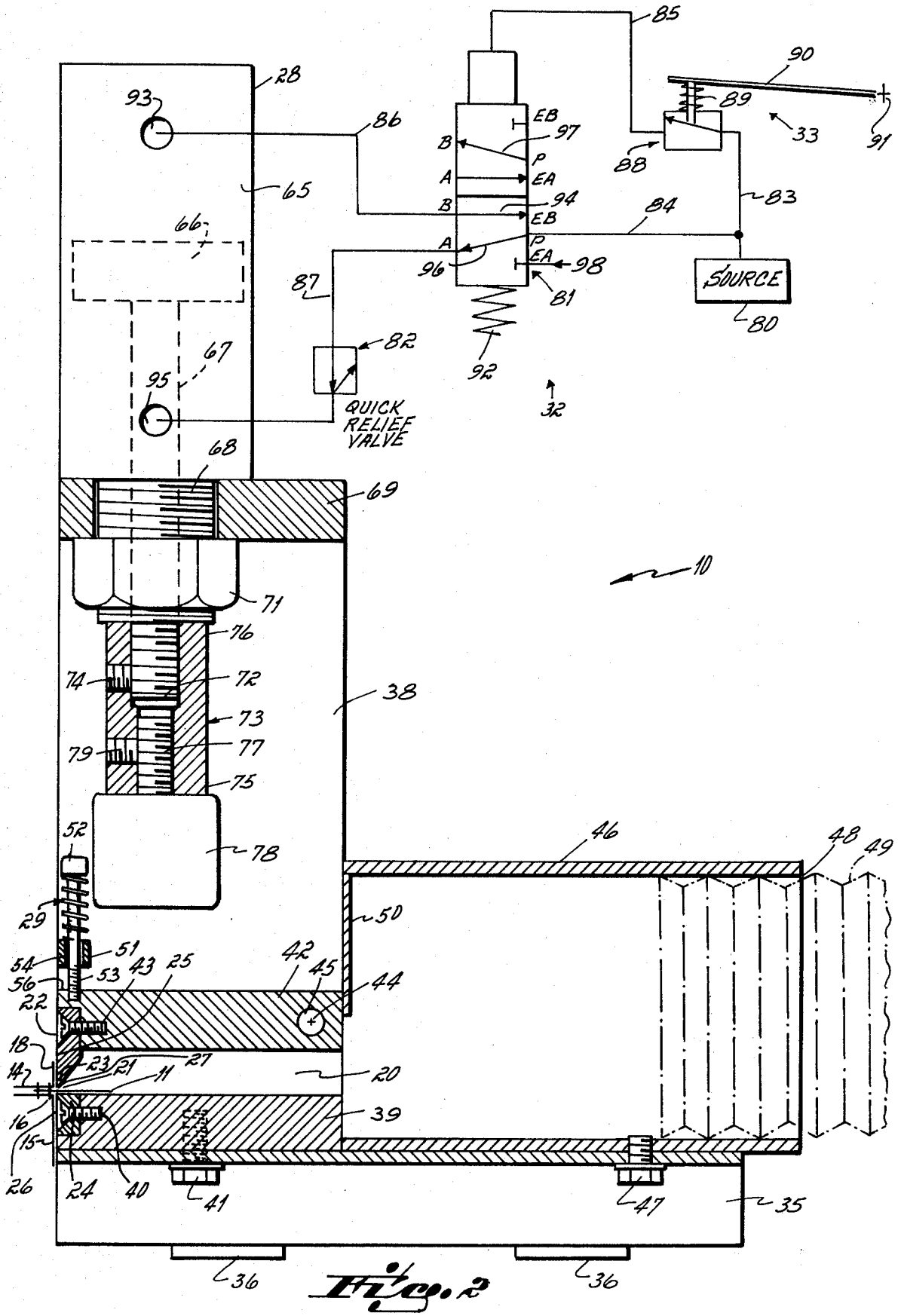
FIG. 2 is a side cross-sectional view taken along line 2—2 of FIG. 1.

The cut off machine 10 is particularly illustrated in FIGS. 1–3. The machine 10 includes a label chamber 20 sized to receive the label 11 therein through an access slot 21 in one wall 22 thereof. A reciprocable cutter bar 23 and an anvil 24 cooperate to define the access slot 21 and at least a portion of that one wall 22 of the label chamber 20. The cutter bar 23 and the anvil 24 present abutment faces 25, 26, respectively which cooperate with the workpiece, i.e., shirt 12, to allow positioning of the label's stitch line 16 closely adjacent the cutting edge 27 of the cutter bar 23 when the label 11 is inserted into the label chamber 20. A cut off motor 28 is operably connected with the cutter bar 23. The cut off motor 28 is selectively operable to drive or hammer the cutter bar 23 into a cut off position with the anvil 24 for cutting off the label 11 from the workpiece 12 when desired by an operator. A return motor 29 is also operably connected with the cutter bar 23. The return motor is operable to return the cutter bar 23 into a stable open position at which a label 11 may be received into the label chamber 20 through the access slot 21. A vacuum source 30 is connectable with the label chamber 20 for establishing a vacuum in the label chamber. The vacuum source 30 cooperates with the cutter bar 23 and anvil 24 to draw the label 11 initially into the chamber through the access slot 21. The vacuum source 30 also cooperates with the cutter bar 23 and anvil 24 to aid in locating the label's stitch line 16 initially adjacent the cutter bar's cutting edge 27, and parallel to that cutting edge, as manually adjusted by the machine's operator. The vacuum source 30 further cooperates with the vacuum chamber 20 to remove a cut-off label from the label chamber 20 into a collector 31 after the label has been cut off from the shirt 12. The cut off motor 23 is in the form of a fluid power cylinder 21 controlled by fluid control circuit 32. The fluid control circuit 32 incorporates a foot operated control switch 33 to permit foot control of the operation of the cut off motor 23, thereby leaving the operator's hands free to maintain proper positioning of the label 11 within the label chamber 20.

More specifically, the label cut off machine 10 includes a base 35 on which the machine is erected. The base 35 is provided with ears 36 that permit it to be bolted to a suitable support table 37 as shown in FIG. 1. Spaced parallel side plates 38 are mounted to the base 39. The machine's anvil 24 is connected to a base plate 39 by machine screws 40, the base plate being mounted between the side plates 38 on the base 35 by bolts 41. The cutter bar 23 is connected to a cutter bar mounting plate 42 by machine screws 43. The cutter bar mounting plate 42, in turn, is connected on pivot axis 44 by pin 45 between the two side plates 38. A tubular connector sleeve 46 is mounted on the base 35 by bolts 47, and is provided with an open end 48 adapted to receive flexible hose 49 from the vacuum source 30. The other end of the connector sleeve 46 is partially closed by end wall 50 which cooperates with the end face of the cutter bar mounting plate 42. The cutter bar mounting plate 42, base plate 39, and side plates 38 thereby cooperate to form the label chamber 20 which is connectable with the vacuum source 30 through the connector sleeve 46 and flexible base 49. The vacuum source is connected with the label chamber 20 through the flexible hose 49, as previously mentioned. The vacuum source 30 is in the nature of an exhaust fan 60 mounted on a lid 61, and may be of any construction well known to the art. The exhaust fan 60 and lid 61 are connected with the collector 31, e.g., a cannister, by quick release latches 62. The exhaust fan 60 is electrically operated and connected with a suitable power source by electric cord 63. Therefore, the vacuum source 30 is adapted not only to supply vacuum to the label chamber 30 through the flexible vacuum hose 49 and connector sleeve 46, but is also adapted to remove cut off labels which fall within the label chamber through the vacuum hose into the collector or cannister 31 for subsequent disposal.

The cutter bar 23 is initially positioned in the open position, and is normally retained in that open position, through use of the return motor 29 which is in the form of return spring. The return spring motor 29 cooperates at one end with a bumper bar 51 fixed between the machine's side plates 38, and at the other end with head 52 of a return bolt 53 that passes through an enlarged pore 54 in the bumper bar. The return bolt 53 is threadedly received in the cutter bar mounting plate 42, adjacent the cutter bar 23 at its other end. With the return spring motor 29, therefore, the cutter bar mounting plate 42, and therefore, the cutter bar 23, is continuously biased toward the open or upraised position shown in FIGS. 2 and 3.

The cutter bar 23 is positively positioned in its upraised or open position by bumper bolts 55 threadedly received in bumper bar 51 and adapted to bear against, but not interconnect with, the top surface 56 of the cutter bar mounting plate 42, see FIG. 3. The bumper bolts 55 are retained in desired position by lock nuts 57. Adjustment of the bumper bolts 55 up or down relative to the immobile bumper bar 51 permits increasing or decreasing the height of the opening of the label access slot 21 as shown in FIG. 3. It may be desired to increase or decrease the height of the label access slot depending on the thickness of the labels 11 being cut off from workpiece 12.

The cut off motor 28 is basically comprised of a fluid power cylinder with a casing 65, piston head 66, and piston rod 67. The motor 28 is mounted on cylinder mounting plate 69 so that the piston rod 67 reciprocates generally normal to the pivot axis 44 of the cutter bar 23. The cylinder's threaded sleeve 68 cooperates with mounting unit 71, the sleeve passing through bore 68 in the mounting plate 69, for connecting the motor 28 to the machine 10. The cylinder mounting plate 69 is retained in fixed position above the cutter bar 23 between the side plates 38 by mounting bolts 70, see FIG. 3. The piston rod 67, is threaded at end 72 into one end of a coupling 73, the coupling being retained in fixed position with that piston rod end by a set screw 74. A stop washer 75 is interposed between the coupling's end 76 and the mount unit 71. The coupling's other end 75, which is of a lesser diameter than the piston rod end 76, receives threaded connector rod 77 fixed to hammerhead 78, the connector rod being threaded into coupling end 75 and being retained in the desired position by the set screw 79. The hammerhead 78 is operably connected with the cutter bar 23 in that it hits the cutter bar mounting plate 42 like a hammer upon activation during the label cut off step, but is structurally connected to the cutter bar only through the machine frame's side plates 38 and cylinder mounting plate 69. This insures a suitable strike force against the cutter bar mounting plate 42, and therefore, cut off force imparted to the cutter bar 23 during the label 11 cut off step.

The cut off motor 28 is included in a fluid circuit 32 that is connectable with a fluid pressure source 80, see FIG. 2. The fluid circuit 32 includes a spool valve 81, a foot control switch 23, and a quick relief valve 82. The high pressure fluid source 80 is connected directly to the foot control switch 33 by first inlet line 83 and to one end of the spool valve 81 by second inlet line 84. The foot control switch 83 is connected to the other end of the spool valve 83 by control line 85. The spool valve 83 is also connected to the motor 28 by power line 85 and by exhaust line 87. The quick relief valve 82 is in the exhaust line 87 section of the fluid circuit 32.

The foot control switch 33 includes a valve 88 that is usually spring 89 loaded to the valve closed position, as shown in FIG. 2. This spring 89 loaded valve 88 is biased to the circuit open or label cut off position through use of an operator's foot on a foot pedal 90, that pedal being pivoted on axis 91 in a frame, not shown. The spool valve 81 is also spring 92 loaded to the circuit exhaust or access slot 58 open position as shown in FIG. 2. The spool valve 81 is biased by spring 92 into that position shown in FIG. 2 where the power port 93 of the fluid motor 28 is exhausted to atmosphere through line 86, 94 and the exhaust port 95 of the fluid motor is exposed to the fluid pressure source through line 96, 87 and one way quick relief valve 82. In the cut off position for the cutter bar 23, and after opening foot controlled valve 88, the fluid pressure source 80 is connected with power port 93 of the power cylinder 28 through lines 97, 86, and the exhaust port 95 of the power cylinder is exhausted to atmosphere through line 87, 98. In this regard, the spool valve 81 is moved from the exhaust position shown in FIG. 2 against the bias spring 92 to a power position, not shown, in response to high pressure fluid from source 80 through lines 80, 85 when the control valve 88 is opened against the bias of spring 89 by depressing foot pedal 90. Importantly, in order to obtain quick exhaust of the power cylinder 28 upon depression of the foot pedal 90, the quick relief valve 82 permits exhaust directly to the atmosphere as well as through line 87 and through exhaust port 98.

In use of the label cut off machine 10 of this invention, and in accord with the label cut off method of this invention, the label 11, which is attached to the workpiece 12 by the stitch line 16, is initially introduced into the label chamber 20 from exteriorly of that chamber with the shirt's yoke 14 and shirt's back 15 being substantially doubled over onto one another as shown in FIG. 2. The label 11 is introduced through the access slot 21 defined by the cutter bar 23 and anvil 24 until it is located within the label chamber at a position where the label stitch line 16 remains exterior of that chamber, but substantially parallel to the cutting edge 21 of the cutter bar 23. The label is manually introduced into the label chamber through the access slot 21 by one of the operator's hands grasping the shirt's yoke 14 section and one of the operator then manipulates those sections 14, 15 so that the yoke's lip 18 flares upwardly and butts against the exterior face 25 of the cutter bar 23, and so that the shirt's back 15 is pressed against the exterior face 26 of the anvil 24. The exterior faces 25, 26 of the cutter bar 23 and anvil 24 thereby act as abutment surfaces against which a portion of the workpiece 12 can be pressed to aid in locating the label stitch line 16 exteriorly of, and generally parallel to and closely adjacent to the cutting edge 27 of the cutter bar 23. As the label 11 is introduced into the label chamber 20 from exteriorly of that chamber, the label chamber is exposed to a vacuum being pulled by vacuum source 20. The vacuum within the label chamber 20 during this time of positioning the label within that chamber aids in introducing the label into the chamber. After the label 11 has been properly positioned within the label chamber 20, the vacuum serves to aid in retaining that label within the chamber at its preferred position where the stitch line 16 is closely adjacent the cutter bar's cutting edge because, in effect, the label chamber 20 is now substantially sealed from atmosphere since slot 21 is substantially closed off by the shirt's yoke 14 and back 15 sections and by label 11 itself.

Thereafter, the control circuit 32 for the fluid motor 28 is activated by foot control switch 33 for energizing the hammerhead 78. The hammerhead 78 sharply strikes the cutter mounting plate 42 as it descends, thereby causing it to pivot on its pivot axis 44. Such pivoting motion of the cutter mounting plate 42 depresses the cutter bar 23 into sharp cut off relation with the anvil 24, thereby cutting off the label 11 interposed between the cutter bar and the anvil closely adjacent its label stitch line 16 to the garment 12. Once the label 11 has been cut off from the garment 12, it is drawn out of the label chamber 20 and into the collector or the canister 31 by the vacuum source through the vacuum hose 49.

It will be particularly noted that, because the label 11 is cut off so very closely adjacent to the label stitch line 16, the lip 18 of the shirt's yoke 14 overlies any small strip of label remaining attached, and which is visible only when the lip 18 is uplifted. This lip 18 also serves to conceal an additional label (not shown) that may be attached to the shirt 12 by a subsequent stitch line (not shown). Thus, the label cut off machine 10 andmethod of this invention serve to quickly and easily, as well as satisfactorily from a commercial retail sales standpoint, cut off a label from a workpiece in a fashion which removes from casual scrutiny the cut off edge of the label due to return of the shirt yoke's lip 18 into overlying relation with the shirt's back 15.

Having described in detail the preferred embodiment of my invention, what I desire to claim and protect by Letters Patent is:

1. A label cut off machine for removing a label sewn to a workpiece, said machine comprising a label chamber sized to receive said label therein through an access slot in one wall thereof, a reciprocable cutter bar and an anvil, said cutter bar and anvil cooperating to define said access slot and at least a portion of said one wall of said label chamber, said cutter bar and said anvil presenting abutment faces which cooperate with said workpiece to allow positioning of said label's stitch line closely adjacent the cutting edge of said cutter bar when said label is inserted into said label chamber, a cut off motor operably connected with said cutter bar, said cut off motor being selectively operable to drive said cutter bar into a cut off position with said anvil for cutting off said label from said workpiece when desired by an operator, and a vacuum source connectable with said label chamber for establishing a vacuum in said label chamber, said vacuum source cooperating with said cutter bar and anvil to draw said label initially into said chamber through said access slot and to aid in locating said label's stitch line initially adjacent said cutter bar's cutting edge, and said vacuum source removing said label from said label chamber after cut off of said label from said workpiece.

2. A label cut off machine as set forth in claim 1, said machine further comprising a control switch for selectively controlling operation of said cut-off motor when desired by an operator.

3. A label cut off machine as set forth in claim 2, said control switch comprising a foot operated control switch.

4. A label cut off machine as set forth in claim 2, said cut off motor comprising a fluid power cylinder, said machine further comprising a fluid circuit connectable with a fluid pressure source, said fluid circuit including said fluid power cylinder and said control switch.

5. A label cut off machine as set forth in claim 4, said fluid circuit further comprising a control valve connected between said control switch and said fluid power cylinder, said control valve being operated by fluid pressure from said fluid pressure source as controlled by said control switch.

6. A label cut off machine as set forth in claim 1, said machine comprising a return motor operably connected with said cutter bar, said return motor being operable to return said cutter bar into a stable open position at which a label may be received into said label chamber through said access slot.

7. A label cut off machine as set forth in claim 6, said return motor comprising a spring motor.

8. A label cut off machine as set forth in claim 1, said machine further comprising a collector adapted to receive labels cut off by said machine, and a vacuum conduit connecting said label chamber and said collector, vacuum being induced into said label chamber through said vacuum conduit and labels being transported from said label chamber to said collector by said vacuum conduit.

9. A label cut off machine as set forth in claim 1, said machine comprising an adjustable bumber connected to said machine, said bumper being adjustable to cooperate with said cutter bar for increasing or decreasing the height of said access slot between said cutter bar and said anvil when said cutter bar is in the open position.

10. A label cut off machine as set forth in claim 9, said bumper comprising a bumper bar fixed relative to said movable cutter bar, and an adjustment screw threadedly connected with said bumper bar.

11. A label cut off machine as set forth in claim 9, said machine comprising a cutter mounting plate connected to said cutter bar, said cutter mounting plate being pivotally connected to said machine and constituting at least a portion of one wall of said label chamber.

12. A label cut off machine as set forth in claim 11, said machine further comprising a hammerhead connected with said cut off cylinder, said hammerhead being adapted to strike said cutter mounting plate with sufficient force to cause said cutter bar to cut off a label from said workpiece upon activation of said cut off cylinder.

13. A method of cutting off a label from a workpiece, said label being attached to said workpiece by a stitch line, said method comrpising the steps of introducing said label into a label chamber from exteriorly of that chamber, said label being positioned between a cutter bar and anvil when said label is located within said label chamber, and said label stitch line being retained exteriorly of that chamber when said label is located within said label chamber, exposing said label chamber to a vacuum for aid in introducing said label into said chamber and in retaining said label in said chamber prior to and during cut off, and selectively reciprocating said cutter bar relative to said anvil for cutting off said label from said workpiece at a location immediately adjacent the stitch line of said label to said workpiece.

14. A method as set forth in claim 13, said method including the step of removing said label from said vacuum chamber through use of the same vacuum that aids in positioning said label within said label chamber.

15. A method as set forth in claim 13, said method comprising the step of utilizing the exterior face of at least one of said cutter bar and said anvil as an abutment surface against which a portion of said workpiece can be pressed to aid in locating said label stitch line exteriorly of, generally parallel to, and closely adjacent to a cutting edge of said cutter bar.

16. A method as set forth in claim 13, said workpiece comprising a first section and a second section, said label being stitched to said workpiece along the same stitch line that connects said first and second sections, said first workpiece section comprising a lip which extends over the face of said label beyond said stitch line, said method comprising the further step of pressing the lip of said first section of said garment against the exterior face of one of said cutter and said anvil, and pressing said second section of said workpiece against the exposed face of one of said cutter bar and said anvil in that area adjacent said cutting edge, thereby positioning said label stitch line in desired position relative to said cutter bar and said anvil.

17. A method as set forth in claim 16, said method comprising the further step of controlling operation of said cutter bar through use of a foot control switch, said foot control switch permiting both hands of the operator to be available for positioning said workpiece in desired cut off relation with said cutter bar.

* * * * *

UNITED STATES PATENT AND TRADEMARK OFFICE

CERTIFICATE OF CORRECTION

PATENT NO. : 4,249,436

DATED : February 10, 1981

INVENTOR(S) : Bobby J. Clay

It is certified that error appears in the above—identified patent and that said Letters Patent is hereby corrected as shown below:

In column 1, line 14, change "industry" to --inventory--.

In column 5, line 42, after "of" insert --the operator's hands grasping the shirt's back 15 section.--

In column 5, line 42, change "the" to --The--.

In column 5, line 54, change "20" to --30--.

In column 6, line 19, add a space between "and" and "method".

In column 7, line 29, change "bumber" to --bumper--.

In column 8, line 50-51, change "permiting" to --permitting--.

Signed and Sealed this

*Fourth* Day of *August 1981*

[SEAL]

*Attest:*

GERALD J. MOSSINGHOFF

*Attesting Officer*

*Commissioner of Patents and Trademarks*